US005348217A

United States Patent [19]

Bettle, Jr. et al.

[11] Patent Number: 5,348,217

[45] Date of Patent: Sep. 20, 1994

[54] BEVERAGE CONTAINER WITH NOVEL DISPENSING MEANS

[75] Inventors: Griscom Bettle, Jr.; Griscom Bettle, III; Patricia Jeruzal, all of Bradenton, Fla.

[73] Assignee: Tropicana Products, Inc., Bradenton, Fla.

[21] Appl. No.: 966,729

[22] Filed: Oct. 26, 1992

Related U.S. Application Data

[63] Continuation of Ser. No. 794,300, Nov. 14, 1991, Pat. No. 5,201,459, which is a continuation of Ser. No. 570,211, Aug. 21, 1990, abandoned.

[51] Int. Cl.[5] ..... B65D 5/72

[52] U.S. Cl. ..... 229/103.1; 215/1 A; 220/705

[58] Field of Search ..... 229/103.1; 220/705–709, 713, 714; 215/1 A

[56] References Cited

U.S. PATENT DOCUMENTS

| | | | |
|---|---|---|---|
| 1,243,033 | 10/1917 | Beatty | 229/103.1 |
| 1,779,350 | 10/1930 | Wright . | |
| 2,146,226 | 2/1939 | Punte . | |
| 2,177,999 | 10/1939 | Schwantes . | |
| 2,416,332 | 2/1947 | Lehman | 229/123.2 |
| 3,182,882 | 5/1965 | Aellen, Jr. et al. | 229/1.5 B |
| 3,194,470 | 7/1965 | Zimmerman et al. | 229/103.1 |
| 3,279,679 | 10/1966 | Engelsher et al. | 229/103.1 |
| 3,303,985 | 2/1967 | Prokes et al. | 229/103.1 |
| 3,397,830 | 8/1968 | Chang | 229/103.1 |
| 3,410,436 | 11/1968 | Foss et al. . | |
| 3,432,087 | 3/1969 | Costello . | |
| 3,458,109 | 7/1969 | Compton et al. . | |
| 3,780,944 | 12/1973 | Zubalik | 229/103.1 |
| 3,792,798 | 2/1974 | Chang | 229/103.1 |
| 3,822,030 | 7/1974 | Tanzer | 229/103.1 |
| 3,874,554 | 4/1975 | Chang | 229/103.1 |
| 4,285,442 | 8/1981 | Wedzik | 229/103.1 |
| 4,318,479 | 3/1982 | Lisiecki | 229/103.1 |
| 4,403,709 | 9/1983 | Meins et al. . | |
| 4,438,865 | 3/1984 | Scatteregia | 220/90.2 |
| 4,574,965 | 3/1986 | Meierhoefer . | |
| 4,591,091 | 5/1986 | Wise . | |
| 4,600,112 | 7/1986 | Shillington et al. . | |
| 4,798,296 | 1/1989 | Lagerstadt et al. . | |
| 4,826,034 | 5/1989 | Foches | 220/90.2 |
| 4,892,187 | 1/1990 | Stein | 206/217 |
| 5,201,459 | 4/1993 | Bettle, Jr. et al. | 229/103.1 |

*Primary Examiner*—Gary E. Elkins
*Attorney, Agent, or Firm*—Kane, Dalsimer, Sullivan, Kurucz, Levy, Eisele & Richard

[57] ABSTRACT

A container for dispensing beverages through a straw, the container including an opening with one or more cuts radiating away therefrom. The opening is smaller than the straw to provide venting.

8 Claims, 3 Drawing Sheets

BEVERAGE CONTAINER WITH NOVEL DISPENSING MEANS

RELATED APPLICATIONS

This is a continuation to application Ser. No. 794,300 filed Nov. 14, 1991, now U.S. Pat. No. 5,201,459, which is a continuation to application Ser. No. 570,211, filed Aug. 21, 1990, now abandoned.

BACKGROUND OF THE INVENTION

1. Field of Invention

This invention pertains to a container for dispensing beverages such as fruit juices with access to allow a straw into the container, and more particularly to a beverage container with an integral access means arranged to permit a straw to be introduced into the container which access means being adapted to provide venting for the container.

2. Description of the Prior Art

It has been found that containers for beverages, such as fruit juices and the like, may be advantageously made of several plies of paper, fiber, plastic or other materials, as well as combinations thereof. Such containers can be made relatively inexpensively yet they are attractive to the customers. Often such containers are provided at least on one surface with a round access hole covered with aluminum foil or other sheet material secured to the container. The beverage is dispensed from the container via a straw, frequently removably secured to the container. For use, the straw is removed from the container, and its tip, which may be slanted to form a piercing point, is used to puncture through and push the cover material out of the hole. The straw is then inserted into the container and used in the normal fashion. A frequent problem with such containers is that because of the very nature of the materials used to make them, the container sidewalls are relatively soft. When a person holds the container while using the straw to break the cover, he inadvertently squeezes the container sidewalls generating a positive pressure to build up therein. Moreover, pressure within the container may also build while the container is being filled, or because of extraneous heat. As a result, when the straw is inserted into the container, liquid may spurt out of the access hole, and/or through the container. Another problem with the above-described containers is that normally the diameter of the round straw conforms to the diameter of the access hole so that once the straw is inserted a seal is formed between the straw and the container wall. This seal prevents air from getting into the container while the beverage is sucked out through the straw. As a result, a negative pressure is generated inside the container which eventually forces the container to collapse before its contents are fully dispensed or to burp when sucking is stopped.

OBJECTIVES AND SUMMARY OF THE INVENTION

In view of the above mentioned disadvantages of the prior art, an objective of the present invention is to provide a beverage container with an access means which vents the container and cooperates with a straw for dispensing the beverage, wherein the beverage does not spurt out when the straw is initially inserted.

A further objective is to provide a beverage container with an access means which provides venting during the beverage dispensing thereby preventing the collapse of the container as the beverage is dispensed.

Yet another objective is to provide a container which is easy to manufacture, yet can be made into an attractive package. Other objectives and advantages of the invention shall become apparent from the following description of the invention. Briefly a beverage container constructed in accordance with this invention includes a closed body with a top surface, access means formed on said top surface and cover means for said access means to maintain the container air and vacuum tight thereby insuring that the beverage disposed therein does not spoil prematurely.

The access means preferably consists of two portions: an opening means having overall dimensions substantially smaller than a corresponding straw; and a plurality of cutting lines extending from the opening means and cooperating therewith to form venting tabs for the container while the straw is inserted into the container and used to dispense a beverage therefrom.

DETAILED DESCRIPTION OF THE INVENTION

Figure 1:
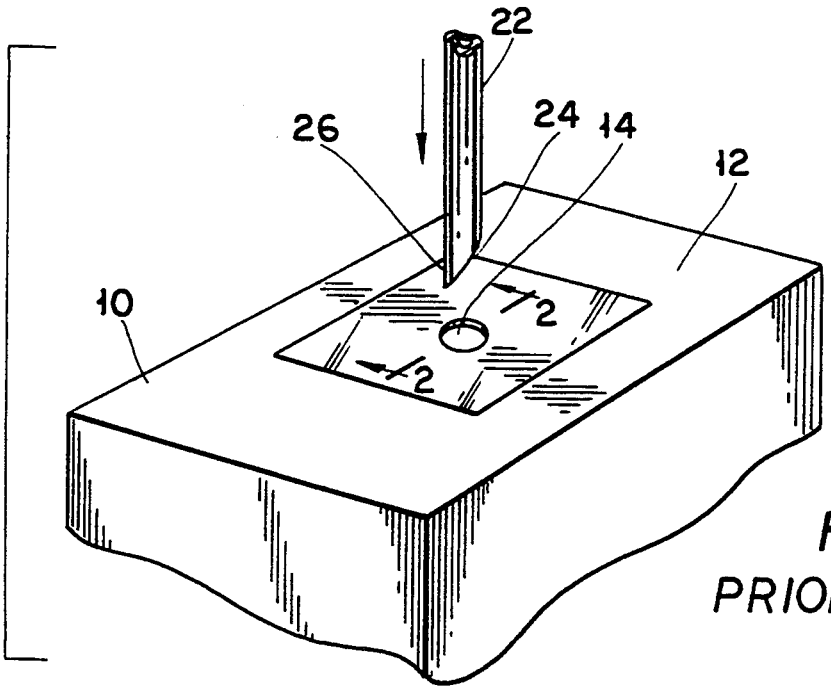
FIG 1 PRIOR ART
FIG. 1 shows a perspective view of a prior art beverage container.
Figure 2:
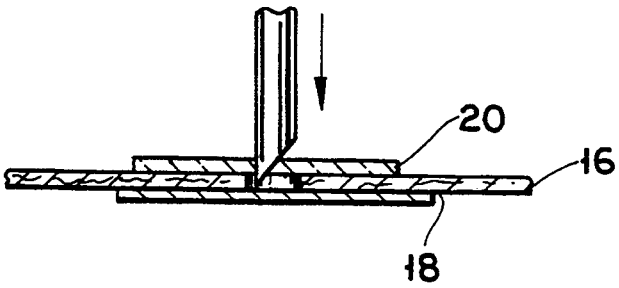
FIG. 2 PRIOR ART
FIG. 2 shows a partial sectional view of the container of FIG. 1 being pierced by a straw.
Figure 4:
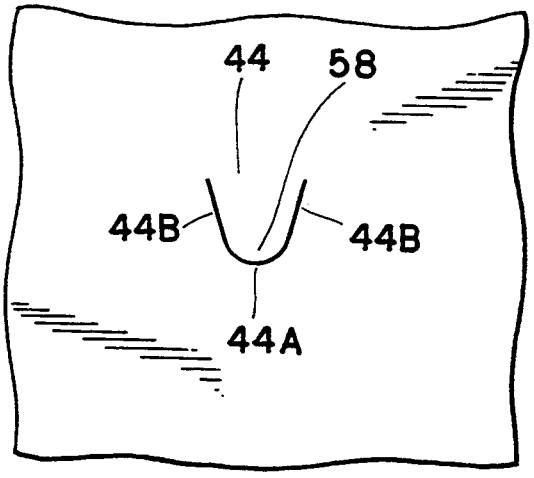
FIG. 4 shows a partial plan view of the beverage container of FIG. 3.

Referring first to FIGS. 1 and 2, a typical prior art beverage container consists of a body 10 which may have a square, rectangular, cylindrical, oval or other geometric shape, with a top surface 12. Surface 12 is provided with a circular access hole 14. The body may be made for example of a paper or cardboard layer 16. Hole 14 is covered with a foil 18 made of a metallic or plastic material to keep the contents from spoiling, at least until the package is opened. Optionally a wrapper 20 is also secured either all around the container, or at least on top of hole 14 to protect the container and maintain it waterproof. The wrapper may be made of a transparent material such as a plastic material. Alternately, wrapper 20 may consist of a pull-away tab.

The beverage from the container 10 may be withdrawn for example by using a straw 22. Frequently straw 22 is cut diagonally at one end, such as 24 to form a piercing point 26. As shown in FIG. 2, the container is opened by pushing the point 26 of straw 22 against the wrapper portion 20 disposed above the hole 14 causing the wrapper 20 and foil 18 to puncture and allowing the straw to be inserted into the container. The disadvantages of the container 10 are discussed above.

Referring now to FIGS. 3–6, the present invention provides a gable-top type container 40 which, like container 10, may have any desired geometric shape. The container 40 includes a top surface 42 with an access means 44. As shown more clearly in FIGS. 5 and 6, the container may be made for example of several layers as described herein. More particularly, the container 40 is made of a cardboard 46, having an inner barrier layer 48 made of a plastic material or a foil. The outside of the container is covered with a protective wrapper 50 preferably made of polyethylene or other plastic material. The three layers 46, 48 and 50 are laminated to each other. Alternatively, the layers 48 and/or 50 are applied over a region of layer 46 adjacent to the access means 44. Importantly the access means 44 consists of two portions: a hole portion 44A, and a plurality of cuts 44B. The portion 44A passes through layer 46 and may have a variety of shapes. Preferably the shape of portion 44A is selected to partially conform to the shape of the straw to be used. For example, if a straw 52 having a circular cross-section is to be used, hole portion 44A has a partially circular shape, having a radius approximately equal to or smaller than the radius of the straw. More particularly, as shown in the Figures, hole portion 44A is in the shape of an arc of circle or arcuate section which does not exceed and is preferably less than 180°. Cuts 44B extend tangentially away from section 44A, each cut having a length which exceeds the radius of section 44A, or straw 52. These cuts 44B define a wedge shaped region 58, therebetween on the surface 42 as shown.

Figure 5:
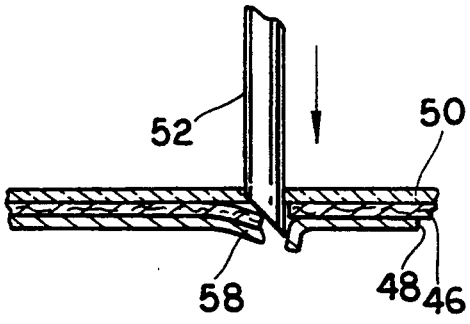
FIG. 5 shows a partial sectional view of the container of FIG. 3 being pierced by a straw.
Figure 6:
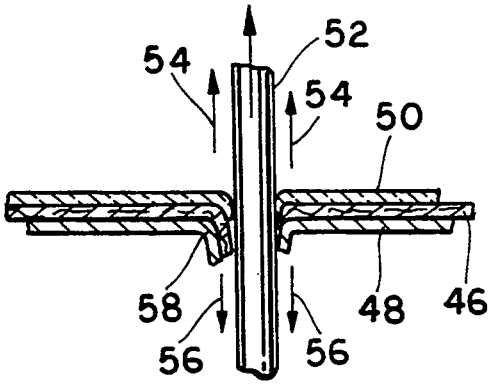
FIG. 6 shows a view similar to FIG. 5 with the straw in position for beverage dispensing.

The beverage container constructed in accordance with this invention is used as follows. A straw 52 (similar to the straw shown in FIGS. 1 and 2) is pushed against the access means 44 as shown in FIG. 5. As the straw 52 is pushed into the container it ruptures the layers 48, 50. Moreover, since the diameter of the straw exceeds the dimensions of the cut 44A, the straw 52 separates the region 58 along cuts 44B and pushes it downwardly to form a tab as shown in FIGS. 5 and 6. Importantly as region 58 separates, it allows gas disposed on top of the container, near access means 44 to escape as indicated by the arrow 54. As a result, during this initial stage, pressure built up within the container is relieved and the beverage will not surge through the straw. When the straw is pushed far enough into the container as shown in FIG. 6, the beverage is sucked out through the straw in the normal manner. In this position, the bent region 58, forms a seal around the straw, however it is shaped so that it will allow air to enter into the container to displace the beverage sucked out as shown by arrow 56. In this manner syphoning and the collapse of the container are avoided.

Of course, other shaped straws may be used as well with a suitable change in the shape of cut 44A. For example, if the straw is triangular, semi-circular section 44A is replaced by a triangular section having smaller dimensions than the straw to insure that when the straw is inserted therein the hole and the regions formed by the cuts act in a manner similar to the one described above.

Figure 3:
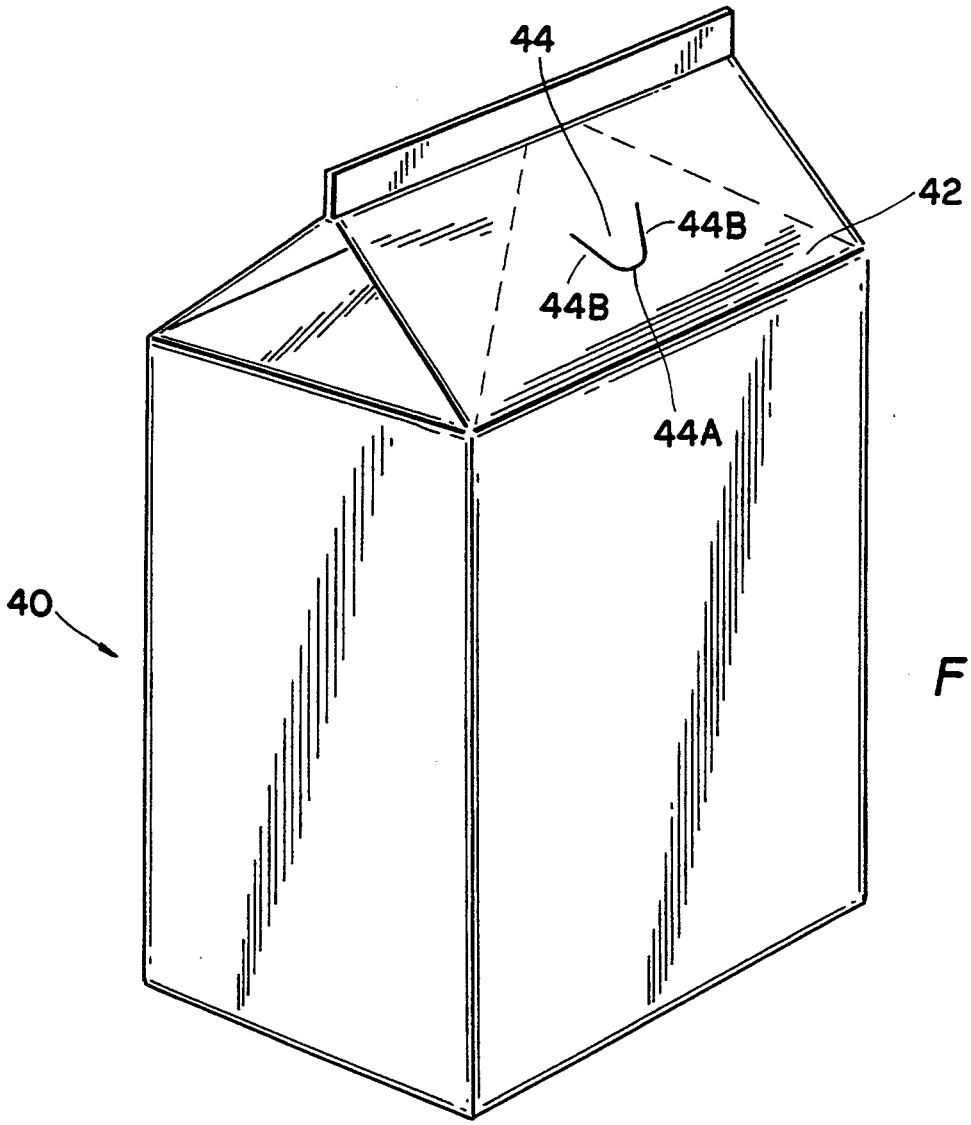
FIG. 3 shows an isometric view of a container constructed in accordance with this invention.
Figure 7:
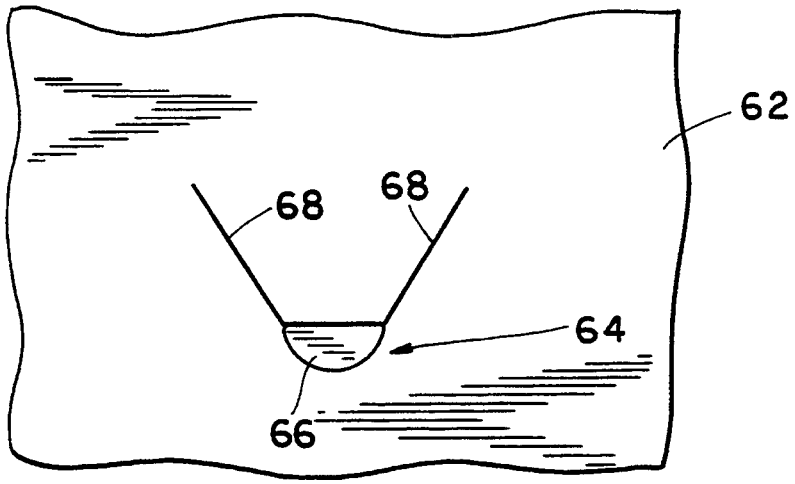
FIG. 7 shows a plan view of an alternate embodiment.

In an alternate embodiment shown in FIG. 7, surface 62 of a container similar to container 40 in FIG. 3, is provided with an access means 64. The access means 64 includes a semicircular D-shaped opening 66 and two or more cuts 68 extending away therefrom. When a straw is inserted into the container, it pierces the layers covering hole 66.

Figure 8:
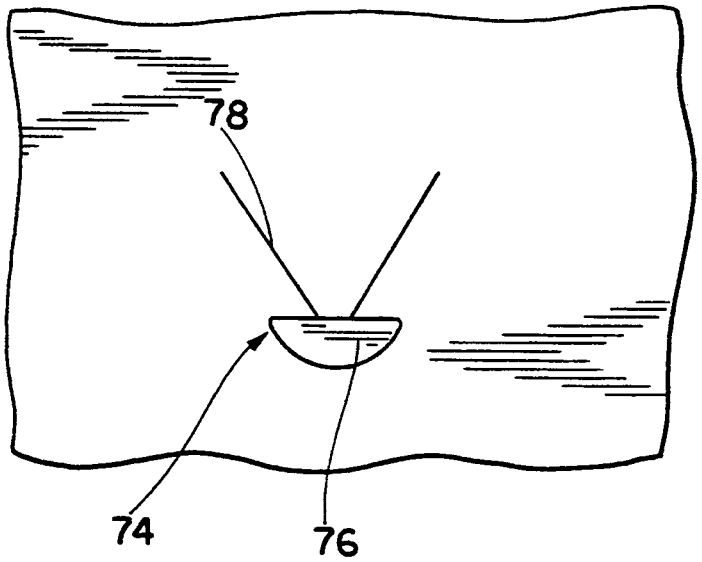
FIG. 8 shows a plan view of another alternate embodiment.

In the embodiment of FIG. 8 access means 74 includes a D-shaped hole 76 and a plurality of cuts 78 spaced closer than in the embodiment of FIG. 7. When a straw (having a diameter equal for or slightly bigger than the diameter of hole 76) is pushed through the container, several tabs formed by cuts 78 are forced and pushed downward between cuts 78.

Obviously numerous other modifications can be made to the invention without departing from its scope as defined in the appended claims.

We claim:

1. A beverage container comprising:

sidewall means and a top wall cooperating to form an enclosure for a beverage; and dispensing means formed on said top wall for dispensing said beverage through a straw having a circular cross section, said dispensing means being defined by a cut made in said top wall, said cut including an arcuate section in the shape of an arc of circle conforming in radius to said circular cross section and extending over no more than 180°, and two straight sections extending away from said arcuate section.

2. The container of claim 1 wherein said straight sections are tangent to said arcuate section.

3. The container of claim 2 wherein said straight sections are convergent toward said arcuate section.

4. The container of claim 1 wherein said arcuate section includes an arcuate portion terminating at a first and a second end and a straight portion extending between said first and second ends.

5. The container of claim 4 wherein said straight sections extend away from said first and second ends respectively.

6. The container of claim 1 wherein said cut is continuous.

7. A beverage container comprising:

sidewall means and a top wall cooperating to form an enclosure for a beverage; and dispensing means formed on said top wall for dispensing said beverage through a straw having a circular cross section, said dispensing means being defined by a cut made in said top wall, said cut including an arcuate section conforming in radius to said circular cross section and extending between a first and a second end, a straight portion extending between said first and second ends and two straight sections extending away from two respective points, said two respective points being disposed radially inwardly of said first and second ends respectively.

8. A beverage container comprising:

sidewall means and a top wall cooperating to form an enclosure for a beverage; and dispensing means formed on said top wall for dispensing said beverage through a straw having a preselected cross section, said dispensing means being defined by a cut made in said top wall, said cut including a curved section conforming in shape to said preselected cross section and extending between a first and a second end, and two straight sections extending away from said ends, said straight sections being convergent toward and tangent to said curved section.

* * * * *